US008789918B2

(12) United States Patent
Danzuka

(10) Patent No.: US 8,789,918 B2
(45) Date of Patent: Jul. 29, 2014

(54) LIQUID EJECTION APPARATUS AND CONTROL METHOD THEREOF

(75) Inventor: Toshimitsu Danzuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 12/716,161

(22) Filed: Mar. 2, 2010

(65) Prior Publication Data

US 2010/0231641 A1 Sep. 16, 2010

(30) Foreign Application Priority Data

Mar. 10, 2009 (JP) ..... 2009-056630

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 6,929,341 | B2 | 8/2005 | Mizoguchi et al. | 347/7 |
| 7,033,006 | B2 | 4/2006 | Ebisawa et al. | 347/85 |
| 2005/0185033 | A1* | 8/2005 | Miki | 347/84 |

FOREIGN PATENT DOCUMENTS

| | | |
|---|---|---|
| JP | 64-087354 | 3/1989 |
| JP | 04-070352 | 3/1992 |
| JP | 2000-326523 | 11/2000 |
| JP | 2003-266745 | 9/2003 |
| JP | 2005-144939 | 6/2005 |
| JP | 2006-069053 | 3/2006 |
| JP | 2007-008014 | 1/2007 |

* cited by examiner

*Primary Examiner* — Alejandro Valencia
(74) *Attorney, Agent, or Firm* — Fitzpatrick, Cella, Harper & Scinto

(57) ABSTRACT

A simple, low-cost liquid ejection apparatus is provided which can prevent a reverse flow of ink from within the cap into the print head, which would otherwise occur when the interior of the cap is returned to an atmospheric pressure. For this purpose, the ink is sucked out of the nozzle ports of the print head by the recovery unit with the atmospheric vent valve of the subtank open.

9 Claims, 2 Drawing Sheets

LIQUID EJECTION APPARATUS AND CONTROL METHOD THEREOF

BACKGROUND OF THE INVENTION

1. Field of the Invention

The present invention relates to a liquid ejection apparatus used in ink jet printing apparatus and the like and also to a method of controlling the same.

2. Description of the Related Art

A general suction-based recovery operation employed in the ink jet printing apparatus will be briefly explained.

In executing the suction-based recovery operation, a general ink jet printing apparatus first causes a cap, which receives sucked-out ink, to come into contact with that face of an ink jet print head (hereinafter also referred to simply as a print head) in which nozzle ports for ink ejection are formed. Next, a suction pump connected to the cap is driven to produce a negative pressure in the cap to suck the viscous ink from the nozzle ports out into the cap. At this time, since the sucked-out ink is discarded as waste ink, the sucking of ink in an amount more than necessary is not desirable. Therefore, a general ink jet printing apparatus, after a predetermined duration of driving the suction pump, opens a release valve on the cap. Alternatively, the cap is parted from the nozzle ports to introduce an atmospheric pressure into the cap, thus limiting the amount of ink being sucked out to the minimum required.

In returning the interior of the cap to the atmospheric pressure, if an absolute value of the negative pressure in the ink jet print head is too large, the ink that has been sucked out into the cap may get back into the print head. As it is brought back into the print head, the ink may carry with it foreign matters, such as dirt in the cap, into the print head, resulting in improper ejections. In an ink jet printing apparatus constructed to suck out different colors of ink through a common cap, a so-called color mixing may result at time of ink ejection.

Japanese Patent Application Laid-Open No. 2005-144939 discloses a technique for preventing color mixing, employed in an ink jet printing apparatus that sucks out different colors of ink through a common cap. Japanese Patent Application Laid-Open No. 2005-144939 prevents the color mixing by supplying ink from an ink cartridge to subtanks to lower the absolute values of the negative pressures in the subtanks or to make the negative pressures equal for all colors.

However, experiments of the inventors have found that even if the negative pressures of the subtanks for different colors were set equal, too large an absolute value of the negative pressure in the print head when the interior of the cap is returned to an atmospheric pressure can result in the color mixing.

Generally, only supplying ink from the ink cartridge to the subtanks cannot lower the absolute values of negative pressure in the subtanks. To lower the absolute values of negative pressure in the subtanks requires, as disclosed in Japanese Patent Application Laid-Open No. 2005-144939, a negative pressure generation mechanism or the like in the subtanks, making the apparatus complicated.

SUMMARY OF THE INVENTION

It is therefore an object of this invention to realize a low-cost liquid ejection apparatus of simple construction capable of preventing ink within a cap from flowing back into the print head when the interior of the cap is restored to an atmospheric pressure. It is another object of this invention to realize a method of controlling the liquid ejection apparatus.

According to the present invention, a liquid ejection apparatus comprising:

a print head to eject a liquid from ejection ports;

a first reservoir means to store the liquid;

a supply means to supply the liquid stored in the first reservoir means to the print head;

an atmospheric vent installed in the supply means and able to communicate with atmosphere; and a suction means to suck out the liquid from the print head;

wherein, when the liquid is ejected from the print head, the atmospheric vent is brought out of communication with the atmosphere and, when the liquid is sucked out from the print head by the suction means, the atmospheric vent is brought into communication with the atmosphere.

According to the present invention, a method of controlling a liquid ejection apparatus, wherein the liquid ejection apparatus has a print head to eject a liquid from ejection ports, a first reservoir means to store the liquid, a supply means to supply the liquid stored in the first reservoir means to the print head, an atmospheric vent installed in the supply means and able to communicate with atmosphere, and a suction means to suck out the liquid from the print head, the control method comprising the steps of:

ejecting the liquid from the print head with the atmospheric vent kept out of communication with the atmosphere; and sucking out the liquid from the print head by the suction means with the atmospheric vent brought into communication with the atmosphere.

This invention has made it possible to realize a low-cost liquid ejection apparatus of simple construction that can prevent a backflow of ink from within the cap into the print head when the interior of the cap is restored to an atmospheric pressure, and also a method of controlling the liquid ejection apparatus.

Further features of the present invention will become apparent from the following description of exemplary embodiments (with reference to the attached drawings).

DESCRIPTION OF THE EMBODIMENTS (First Embodiment)

Now, a first embodiment of this invention will be explained by referring to the accompanying drawing.

Figure 1:
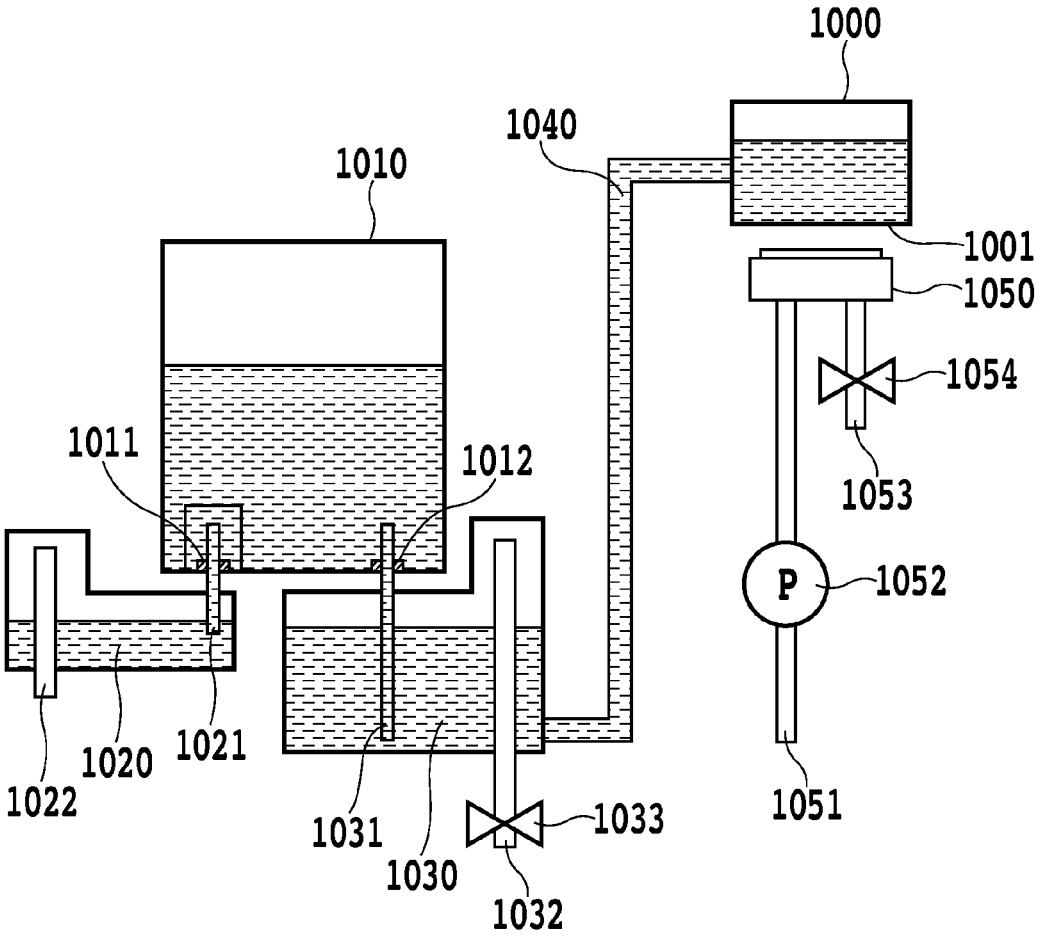
FIG. 1 is a cross-sectional view schematically showing essential parts of the liquid ejection apparatus as a first embodiment.

FIG. 1 is a cross-sectional view schematically showing essential parts of the liquid ejection apparatus of this embodiment. Although FIG. 1 shows a construction for one kind of liquid, a plurality of the similar constructions may be provided for a corresponding number of different kinds of liquids. An ink jet print head (also referred to simply as a print head) 1000 has a nozzle port-formed surface 1001 having liquid ejection ports (nozzle ports) for ejecting liquid (ink) formed therein. In each of the nozzle ports there is provided an electrothermal converter which, when applied an electric signal, generates a bubble in ink whose pressure expels an ink droplet from the nozzle ports.

The liquid ejection means is constructed mainly of these electrothermal converters and nozzles. A main tank (first reservoir means) 1010 has rubber plugs 1011, 1012 with a slit.

When the main tank 1010 is mounted on the liquid ejection apparatus, a supply needle 1021 installed in a buffer chamber 1020 and a supply needle 1031 installed in a second reservoir means (subtank) 1030 pierce through the rubber plugs 1011, 1012. The buffer chamber 1020 is provided with a second atmospheric vent 1022. The first reservoir means is constructed mainly of the main tank 1010, supply needle 1021 and buffer chamber 1020. The subtank 1030 is provided with a first atmospheric vent 1032 that can be brought into or out of communication with atmosphere as an atmospheric vent valve 1033 is opened and closed.

Provided between the subtank 1030 and the print head 1000 is an ink supply tube 1040 through which ink stored in the subtank 1030 is supplied to the print head 1000. A liquid supply means is constructed mainly of the supply needle 1031, the ink supply tube 1040 and a part of the print head 1000. Further, the liquid ejection apparatus has a liquid suction means constructed mainly of a cap 1050, a suction tube 1051, a suction pump 1052, an atmospheric relief tube 1053 and an atmospheric relief valve 1054.

Now, in the liquid ejection apparatus of the first embodiment, an explanation on the liquid suction operation will be given as follows. An original ejection performance is recovered by removing viscous ink and dirt from inside the nozzles by suction. For this purpose, in sucking out a liquid (ink) from the liquid ejection ports (nozzle ports), the first step is to engage the cap 1050 against the nozzle port-formed surface 1001 of the print head 1000 and then close the atmospheric relief valve 1054. Next, the atmospheric vent valve 1033 is opened, followed by the suction pump 1052 being driven. With the suction pump 1052 operated, the interior of the cap 1050 becomes negative in pressure, drawing the ink out of the nozzle ports of the print head 1000 into the cap 1050. The ink thus sucked out is led to a waste ink tank not shown. Since the ink is sucked out with the atmospheric vent valve 1033 open, air enters through the first atmospheric vent 1032.

After the suction pump 1052 has been operated for a predetermined period, the atmospheric relief valve 1054 is opened, communicating the interior of the cap 1050 to the atmosphere to let the open air flow into the cap 1050 through the atmospheric relief tube 1053. At this time although some negative pressure remains in the interior of the print head 1000, its absolute value is small compared with that when the similar suction operation is done with the atmospheric vent valve 1033 closed. This is because a flow resistance in a path from the first atmospheric vent 1032 to the nozzle ports is smaller than the one from the second atmospheric vent 1022 to the nozzle ports. As the operation of the suction pump 1052 increases the absolute value of the negative pressure within the cap 1050, the absolute value of the negative pressure in the print head 1000 also increases. However, the negative pressure in the print head 1000 begins to decrease as the ink is supplied to the print head from the ink supply tube 1040. That is, the smaller the flow resistance in the path from the first atmospheric vent 1032 to the print head 1000, the smaller the absolute value of the negative pressure inside the print head 1000 will be when the atmospheric relief valve 1054 is opened.

There are two supply needles 1021, 1031 with extremely small diameters in an ink path between the first atmospheric vent 1032 and the second atmospheric vent 1022. Therefore, the flow resistance in the path from the second atmospheric vent 1022 to the nozzle ports is greater than that from the first atmospheric vent 1032 to the nozzle ports. If the absolute value of the negative pressure in the print head 1000 at time of opening the atmospheric relief valve 1054 is small, it is almost unlikely that the ink that has been sucked out into the cap 1050 may flow back into the print head 1000. This in turn avoids foreign matters being drawn into the print head 1000 along with the reverse-flowing ink, which results in an extremely low frequency of occurrence of improper ejection.

Sucking out ink with the atmospheric vent valve 1033 open, as described above, has resulted in almost no ink backflow into the print head 1000, making the frequency of occurrence of improper ejection caused by the trapping of foreign matters in the print head 1000 extremely low. Although in the above construction the suction pump 1052 has been described to be operated after opening the atmospheric vent valve 1033, the atmospheric vent valve 1033 may be opened at any time while the suction pump 1052 is operated. This is because even such a construction can also make small the absolute value of the negative pressure inside the print head 1000 following the suction operation.

After the atmospheric relief valve 1054 is open, it is preferred that the known operations be performed, such as wiping, preliminary ejection and a cap evacuating suction for clearing the cap 1050 of sucked-out ink.

In the liquid ejection apparatus of this embodiment, if the atmospheric vent valve 1033 is left open, the ink stored in the main tank 1010 naturally falls into the subtank 1030 by the action of gravity. This, however, takes time. So, the ink in the main tank 1010 may be forcibly moved into the subtank 1030 by the method described below.

An open-close valve is installed in the ink supply tube 1040. Further, a suction pump is installed in the first atmospheric vent 1032. Then, with the open-close valve closed, the suction pump is operated to draw air from the subtank 1030 to force the ink stored in the main tank 1010 to flow into the subtank 1030. In that case, a detection means to detect the amount of ink accommodated in the subtank 1030 is installed in the subtank 1030. According to the measurement by the detection means, the start and stop of the suction pump may be controlled.

In the liquid ejection apparatus of this embodiment, on the other hand, the ink ejection from the nozzle ports is done with the atmospheric vent valve 1033 closed. This allows the ink stored in the main tank 1010 to be supplied to the print head 1000 through the subtank 1030 and the ink supply tube 1040 as the ink is consumed by the print head performing the ink ejection. As a result, there is no need to drive the pump to forcibly move the ink from the main tank 1010 to the subtank 1030.

It is noted that the amount of ink ejected from the nozzle ports per unit time during the ink ejection operation is much smaller than the amount of ink sucked out of the nozzle ports per unit time during the ink sucking operation. Therefore, even if the flow resistance in the path from the second atmospheric vent 1022 to the nozzle ports is large, no trouble will result.

The liquid ejection apparatus of this embodiment can be applied to a so-called serial type printing apparatus that performs the printing by moving the ink jet print head in a direction crossing the print medium feeding direction. In that case, the apparatus may preferably be constructed to have the print head 1000 mounted on a movable carriage, which is supplied ink through the ink supply tube 1040. The liquid ejection apparatus of this embodiment can also be applied to a full-line type ink jet printing apparatus that performs the printing by moving a print medium in a feed direction with the print head kept in a fixed position.

(Second Embodiment)

A second embodiment of this invention will be explained by referring to the accompanying drawing.

While in the first embodiment, the liquid ejection apparatus constructed to eject only one kind of ink has been taken up as an example for the explanation of the present invention, the second embodiment will explain an example of the liquid ejection apparatus constructed to eject different kinds (colors) of ink.

Figure 2:
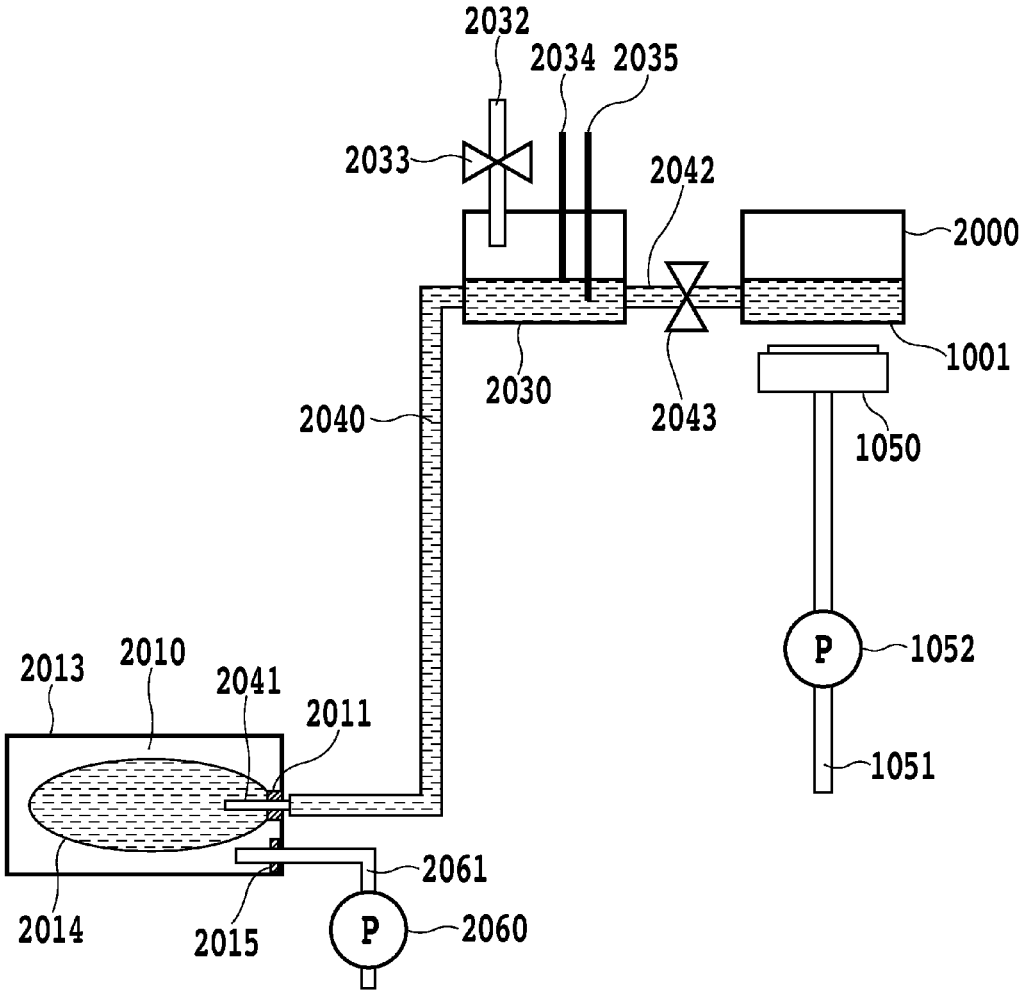
FIG. 2 is a cross-sectional view schematically showing essential parts of the liquid ejection apparatus as a second embodiment.

FIG. 2 is a cross-sectional view schematically showing essential parts of the liquid ejection apparatus of this embodiment. Those parts in this embodiment that are identical with the corresponding parts in the first embodiment are assigned like reference numbers. The liquid ejection apparatus of this embodiment is constructed to eject four colors—cyan, magenta, yellow and black—and has four systems of the main tank, the ink supply tube and others, one for each of the four colors. The four systems have entirely the same constructions, so only one system is shown in FIG. 2.

In FIG. 2, an ink jet print head (also referred to simply as a print head) 2000 has a plurality of nozzle ports to eject four colors of ink. In each of the nozzle ports there is provided an electrothermal converter.

A main tank 2010 for each color is removably mounted on the liquid ejection apparatus and stores ink in a flexible ink bag 2014 accommodated in a housing 2013. The ink bag 2014 for each color is provided with a rubber plug 2011 with a slit. When the main tank 2010 is mounted on the liquid ejection device, a supply needle 2041 connected to the end of a first ink supply tube 2040 pierces through the rubber plug 2011.

The housing 2013 for each color has an O-ring 2015, through which a pressure tube 2061 for that color pierces when the main tank 2010 is mounted on the liquid ejection apparatus. The pressure tube 2061 for each color has mounted thereon a tube-pump type pressure pump 2060 with a pressure tube pressing roller of the corresponding color. An end of the pressure tube 2061, which is opposite the end piercing the O-ring 2015, communicates with atmosphere.

Further, the first ink supply tube 2040 for each color is connected at its end, opposite the one connected with the supply needle 2041, to a subtank 2030 of the corresponding color. Between the subtank 2030 for each color and the print head 2000 is installed a second ink supply tube 2042 of the corresponding color.

The second ink supply tube 2042 has a supply valve 2043. The subtank 2030 for each color is provided with a first atmospheric vent 2032 having an atmospheric vent valve 2033. Further, the subtank 2030 is also provided with two sensor pins 2034, 2035 for detecting the amount of ink in the subtank 2030. The presence or absence of electric conduction between the two sensor pins 2034, 2035 reveals whether the ink level in the subtank 2030 for each color is above or below the lower end of the sensor pin 2034.

A cap 1050 is intended to cap all the nozzle ports in the print head 2000 that are designed to eject four colors of ink.

An ink suction operation in the liquid ejection apparatus of this embodiment will be explained as follows. A first step in drawing ink from the nozzle ports by suction is to open the supply valve 2043. Next, the cap 1050 is engaged with the nozzle port-formed surface 1001 of the print head 2000 and in this state the atmospheric vent valve 2033 for each color is opened. Then, the suction pump 1052 is started to evacuate the interior of the cap 1050, bringing the pressure in the cap to a negative to draw ink from a plurality of nozzle ports out into the cap by suction.

After the suction pump 1052 has been operated for a predetermined duration, the cap 1050 is parted from the nozzle port-formed surface 1001. At this time, although some negative pressure remains in the print head 2000, as in the case of the first embodiment, the absolute value of the negative pressure is substantially smaller than when the similar suction operation is executed with the atmospheric vent valve 2033 closed. This is because the flow resistance in the path from the first atmospheric vent 2032 for each color to the nozzle ports of the corresponding color is smaller than that from the main tank 2010 for each color to the nozzle ports of the corresponding color.

The first ink supply tube 2040 connecting the main tank 2010 and the subtank 2030 for each color is long and the supply needle 2041 attached to the end of the first ink supply tube 2090 is small in diameter. If the suction operation is to be performed with the atmospheric vent valve 2033 closed, the pressure tube pressing roller of the pressure pump 2060 for each color is deactivated. That is, the suction is done by communicating the space between the housing 2013 of the main tank 2010 and the ink bag 2014 for each color to the atmosphere. This means that the resistance the ink bag 2019 exhibits as it is contracted adds to the flow resistance. Therefore, the flow resistance of a path from the main tank 2010 for each color to the nozzle ports of the corresponding color becomes large compared with the flow resistance of a path from the first atmospheric vent 2032 for each color to the nozzle ports of the corresponding color.

As described above, by performing the suction operation with the atmospheric vent valve 2033 open, the backflow of ink into the print head 2000 can be prevented almost entirely, eliminating the color mixing. Although in the above construction the suction pump 1052 has been described to be operated after opening the atmospheric vent valve 2033, it is possible to open the atmospheric vent valve 2033 while the suction pump 1052 is in operation. This is because even such a construction can also make small the absolute value of the negative pressure inside the print head 2000 following the suction operation.

After the cap 1050 is parted from the nozzle port-formed surface 1001, it is preferred that the known operations be performed, such as wiping, preliminary ejection and a cap evacuating suction for clearing the cap 1050 of sucked-out ink. The wiping and the preliminary ejection using a small volume of ink have proved to be effective in preventing the so-called color mixing. The sucked-out ink is led through the suction tube 1051 into a waste ink tank not shown.

Since the ink suction operation is done with the atmospheric vent valve 2033 open, air enters through the first atmospheric vent 2032 for each color. In the liquid ejection apparatus of this embodiment, the ink stored in the main tank 2010 may be moved into the subtank 2030 after the ink has been drawn out of the nozzle ports by suction. As a first step, a check is made as to whether the sensor pins 2034, 2035 in the subtank 2030 for each color are electrically conducting. If the sensor pins 2034, 2035 are found not conducting for a particular color, this means that the amount of ink of that color in the subtank 2030 is running low.

The following operation is performed only on the system of a color for which the amount of ink is found to be at a low level. First, the supply valve 2043 is closed. Next, the pressure tube pressing roller of the pressure pump 2060 is activated and then the atmospheric vent valve 2033 is opened. Then, the pressure pump 2060 is operated to move the ink from the main tank 2010 to the subtank 2030. When the sensor pins 2034, 2035 in the subtank 2030 become electrically conductive, the pressure pump 2060 is stopped. This is followed by the closing of the atmospheric vent valve 2033, the deactivation of the pressure tube pressing roller of the pressure pump 2060 and the opening of the supply valve 2043.

When the liquid ejection apparatus of this embodiment ejects ink from its nozzle ports, the pressure tube pressing roller of the pressure pump 2060 is deactivated for all colors. That is, the ink ejection operation is done with the space between the housing 2013 and the ink bag 2014 for each color communicated to the atmosphere and with the atmospheric vent valve 2033 for each color closed.

This allows the ink stored in the main tank 2010 of each color to be supplied to the print head 2000 through the first ink supply tube 2040 and subtank 2030 of the corresponding color as the ink is consumed by the print head performing the ink ejection. This obviates the need to drive the pump for the forced delivery of ink from the main tank 2010 to the subtank 2030.

It is noted that the amount of ink ejected from the nozzle ports per unit time during the ink ejection operation is much smaller than the amount of ink sucked out of the nozzle ports per unit time during the ink sucking operation. This means that even if the flow resistance in the path from the main tank 2010 to the nozzle ports is large, no trouble will result.

While the liquid ejection apparatus of the first and second embodiment have been described to have electrothermal converters installed inside the nozzle ports of the print head, this invention is not limited to such a construction and may use other devices such as piezoelectric devices.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-056630, filed Mar. 10, 2009 which is hereby incorporated by reference herein in its entirety.

What is claimed is:

1. A liquid ejection apparatus comprising:

a print head configured to eject liquid from ejection ports;

a first reservoir configured to reserve liquid to be supplied to the print head;

a second reservoir provided between the first reservoir and the print head, and configured to reserve liquid to be supplied to the print head;

a switching unit configured to switch between a first state in which the second reservoir does not communicate with atmosphere and a second state in which the second reservoir communicates with atmosphere;

a cap configured to cap the print head;

a suction pump configured to suction liquid from the print head by communicating with the cap and producing negative pressure in the cap;

control means for controlling the switching unit, so as to switch the switching unit to be in the first state when performing a printing operation to a print medium by ejecting the liquid from the print head and so as to switch the switching unit to be in the second state when liquid is suctioned from the print head by driving the suction pump.

2. The liquid ejection apparatus according to claim 1, wherein the liquid ejection apparatus is adapted to eject a plurality of different kinds of liquid, and further comprising respective ones of the print head and the first reservoir for each of the plurality of kinds of liquids.

3. The liquid ejection apparatus according to claim 1, wherein the switching unit comprises an atmospheric vent installed in the second reservoir.

4. The liquid ejection apparatus according to claim 1, wherein the first reservoir is detachable from a main body of the liquid ejection apparatus.

5. The liquid ejection apparatus according to claim 4, further comprising a needle connecting the first reservoir and the second reservoir.

6. The liquid ejection apparatus according to claim 1, further comprising a buffer chamber communicating with the first reservoir and atmosphere.

7. The liquid ejection apparatus according to claim 6, further comprising a needle connecting the first reservoir and the buffer chamber.

8. The liquid ejection apparatus according to claim 1, wherein the control means starts driving of the suction pump after the switching unit is switched such that the second reservoir communicates with atmosphere when the liquid is sucked from the print head.

9. The liquid ejection apparatus according to claim 1, wherein the control means switches the switching unit such that the second reservoir communicates with atmosphere after start of driving of the suction pump.

* * * * *